US007320481B2

(12) United States Patent
Tsubouchi

(10) Patent No.: US 7,320,481 B2
(45) Date of Patent: Jan. 22, 2008

(54) HANDBOOK AND METHOD FOR MAKING SAME

(75) Inventor: Takao Tsubouchi, Aichi (JP)

(73) Assignee: Hisago Label Co., Ltd., Aichi (JP)

( * ) Notice: Subject to any disclaimer, the term of this patent is extended or adjusted under 35 U.S.C. 154(b) by 493 days.

(21) Appl. No.: 10/797,047

(22) Filed: Mar. 11, 2004

(65) Prior Publication Data

US 2005/0200115 A1 Sep. 15, 2005

(51) Int. Cl.
*B42D 15/00* (2006.01)

(52) U.S. Cl. ..... 281/15.1; 281/2; 281/36; 283/61; 283/62

(58) Field of Classification Search ..... 281/2, 281/3.1, 5, 15.1, 21.1, 36–38; 283/61, 62, 283/63.1, 64

See application file for complete search history.

(56) References Cited

U.S. PATENT DOCUMENTS 1,500,777 A * 7/1924 Stevenson ..... 434/354
3,275,316 A * 9/1966 Cleary, Jr. ..... 270/52.24
4,492,306 A * 1/1985 Cooper et al. ..... 206/216
4,685,699 A * 8/1987 Hirasawa ..... 281/15.1
4,717,176 A * 1/1988 Matthews ..... 281/15.1
4,789,187 A * 12/1988 Corlew et al. ..... 281/15.1
5,029,902 A * 7/1991 Komori ..... 283/56
5,098,127 A * 3/1992 Williamson et al. ..... 281/15.1
5,104,146 A * 4/1992 Schulz et al. ..... 281/15.1
5,636,872 A * 6/1997 Gamer et al. ..... 283/49
5,826,914 A * 10/1998 Hudetz ..... 283/61

FOREIGN PATENT DOCUMENTS

JP 2004-102059 2/2004

* cited by examiner

*Primary Examiner*—Dana Ross
(74) *Attorney, Agent, or Firm*—Wenderoth, Lind & Ponack, L.L.P.

(57) ABSTRACT

An easy care handbook constituted by a bound booklet containing recording pages and private information pages can be prepared by a simple method. The recording pages of the bound booklet are common for all users so that the bound booklet can be made in volume at a low price. The private pages are formed by a printable sheet having a printable side, an adhesive layer on the other side, and a detachable sheet removably attached onto the adhesive layer. Private information from a database can be printed by a printer onto the printable side prior to incorporating the printable sheet into the booklet. The detachable sheet is removed from the preprinted printable sheet and the adhesive layer is attached onto the recording page to form the private information pages.

4 Claims, 9 Drawing Sheets

HANDBOOK AND METHOD FOR MAKING SAME

BACKGROUND OF THE INVENTION

1. Field of the Invention

The present invention relates to a handbook and a method for making the same. More specifically, the present invention relates to a permanently bound handbook comprising at least one generalized page, generally related to the use of the handbook, and at least one specialized page, containing particular content related to the specific use of the handbook, and a method for making the same.

2. Description of the Prior Art

A permanently bound handbook, comprising at least one generalized page generally related to the use of the handbook, and at least one specialized page containing particular content related to the specific use of the handbook, is frequently used, especially in fields where it functions as at least one of an official record and an indication of qualification. One example is a car maintenance book which comprises specialized pages containing specific information about each car in front, and generalized pages containing service coupons or recording spaces for the maintenance history of the car in back. Another example is a medical record book which comprises specialized pages containing personal information for each patient in front, and generalized pages for recording the treatment the patient receives in back.

Still another example is the one used in the Japanese Social Welfare System. According to the System, a person who is going to receive benefits and support services from a municipality has to get a certificate, which is usually provided in the form of a handbook of the type described above. The Japanese Patent Laid-open No. H10-6660 discloses a handbook of this type. In the typical handbook of care-certificate, several pages in the beginning of the handbook are private information pages on which private information for each recipient is written, and the rest of the pages of the handbook are recording pages on which the recipient's history of use of the services etc. is to be recorded. The recording pages of the handbook are general for all recipients and are in a fixed form, including recording spaces in which an outline of the services the recipient receives is to be recorded at that time.

On the other hand, the private information page differs depending upon each recipient. Usually, the private information includes many items such as: name, address, date of birth, and claim number of the recipient; name and address of the person with a support obligation to the recipient; issue date; name of the municipality; benefit period, amount of service, and obligation fee for the recipient or a payment provider which are determined on a service-to service basis such as for in-home service, day-care, or short-term stay. Handwriting such private information in the private information pages requires a large amount of labor and man-hours.

According to the conventional methods, the private information specific for each recipient has to be written by hand in the private information pages of a handbook which had been previously prepared by binding several pages containing blank spaces together with the recording pages. Otherwise, the handbook has to be bound individually, because the private information page specific for each recipient has to be printed before being permanently bound with the recording pages.

The above-described methods require troublesome chores. Thus, there is a strong demand for an efficient system, especially in big municipalities where the number of recipients and handbooks are large.

SUMMARY OF THE INVENTION

The present invention has been made in consideration of the above-described situation. Therefore, the object of this invention is to provide a handbook which can be prepared by a simple method and is easy to use. Herein, the word "page" is defined as one surface of a sheet of material, and a "specialized page" is defined as any page containing particular content for each use.

A handbook according to this invention comprises: at least one generalized page; and at least one specialized page. The specialized page contains particular content related to the specific use of the handbook, and the generalized page is generally related to the use of the handbook. The specialized page is formed by at least a part of a printable sheet comprising: an adhesive side with an adhesive layer on at least a part of the sheet; and a printable side containing the particular content printed by a printing means. The at least one specialized page is formed by attaching at least part of the adhesive side of the printable sheet to at least one generalized page.

A handbook according to this invention can further function as at least one of an official record and an indication of qualification.

Handbooks according to this invention can further have two or more generalized pages permanently bound together prior to attaching the at least one specialized page.

Handbooks according to this invention can have the printable side of the printable sheet further comprising: multiple printing spaces. The multiple printing spaces form corresponding multiple pages of the specialized pages. The adhesive layer is formed on at least a portion of the back of one of the printing spaces.

Handbooks according to this invention can have the printable side of the printable sheet further comprising: multiple printing spaces and at least one fold line. The multiple printing spaces form corresponding multiple pages of the specified pages. The fold line is disposed along a border between at least two of the printing spaces by which the printable sheet can be folded up into concertinas. The adhesive layer is formed on at least a portion of the back of each of the printing spaces.

Handbooks according to this invention can have the printable side of the printable sheet further comprising multiple printing spaces. The at least one printing space is separable from the printable sheet. The adhesive layer is formed on at least a portion of the back of each of the printing spaces.

Handbooks according to this invention can have the printable surface of the printable sheet further comprising at least one perforated line disposed along the border between at least two of the printing spaces. At least one of the printing spaces can be separated from the printable sheet by the perforated line.

Handbooks according to this invention can have the size of the printing space smaller than that of the generalized page.

A method according to this invention for making a handbook comprises the steps of printing particular content on at least one printable sheet using a printing means. The printable sheet comprises: an adhesive side having an adhesive layer on at least a part of it; a printable side; and a detachable sheet removably attached to the adhesive layer. The method further comprises removing the detachable sheet from the printable sheet; and pressing the adhesive layer to at least one generalized page generally related to the use of the handbook, in order to attach at least a part of the printable sheet to the generalized page, and to form at least one specialized page containing particular content related to the specific use of the handbook.

In a method according to this invention, the handbook can further function as at least one of an official record and an indication of qualification.

Methods according to this invention further comprise the steps of retrieving the particular content from a database; and transferring the particular content to a printing means.

One aspect of the present invention is a handbook where the specialized page is formed by the printable sheet, having a printable side, an adhesive side including the adhesive layer, and the detachable sheet removably attached onto the adhesive layer, having at least a part of the printable sheet attached onto at least one of the generalized pages. The generalized pages generally related to all use can be made and bound together in volume at a low price. In the meantime, the particular content of the specialized page can be printed by a printing means onto the printable sheet. The particular content can be retrieved from a database prepared in advance, and outputed through a printing means when needed. The specialized page is incorporated into the booklet containing the generalized pages by attaching at least a part of the preprinted printable sheet onto at least one of the generalized pages. With this constitution, troublesome chores of handwriting or individual binding are not required. Thus, time and costs for preparing the handbook can be reduced.

In another aspect of the present invention, the printable sheet further comprises multiple printing spaces which form corresponding multiple pages of the specialized pages and an adhesive layer formed on at least a portion of the back of one of the printing spaces. The preprinted printable sheet is incorporated into the booklet by attaching the adhesive layer onto at least one of the generalized pages. Other parts of the preprinted printable sheet, including the rest of the printing spaces,are folded and held within the booklet. With this construction, the quantity of the adhesive and the size of the detachable sheet can be reduced, and thus, the cost of the handbook can also be reduced.

In yet another aspect of the present invention, the printable sheet further comprises fold lines by which the printable sheet can be folded up into concertinas and the adhesive layer is formed on at least a portion of the back of each of the multiple printing spaces. The adjacent printing spaces can be attached back to back to each other to form the specialized pages. With this constitution, the handbook is easy to use because the specialized pages can be kept neatly within the handbook, even when it is opened.

In still another aspect of the present invention, the printable sheet comprising multiple printing spaces can be separated into at least one printing space and another printing space. The adhesive layer is formed on at least a portion of the back of each of the printing spaces. To separate the printable sheet, cutting lines can be made, and disposed along a border of the printing spaces. The separated preprinted printing space can be attached onto a desired position of a generalized page in the booklet. With this constitution, the handbook is easy to care for because when the content of one of the specialized pages needs to be modified, only one printing space has to be reprinted and attached over the relevant page.

In yet still another aspect of the present invention, the size of the printing space is smaller than that of the generalized page. With this constitution, positioning and attachment of the preprinted printable sheet or the preprinted printing space onto the generalized page becomes easy because the printing space can be fit within the generalized page even despite a small displacement from a desired position.

DETAILED DESCRIPTION OF THE PREFERRED EMBODIMENTS

First Embodiment

Figure 2:
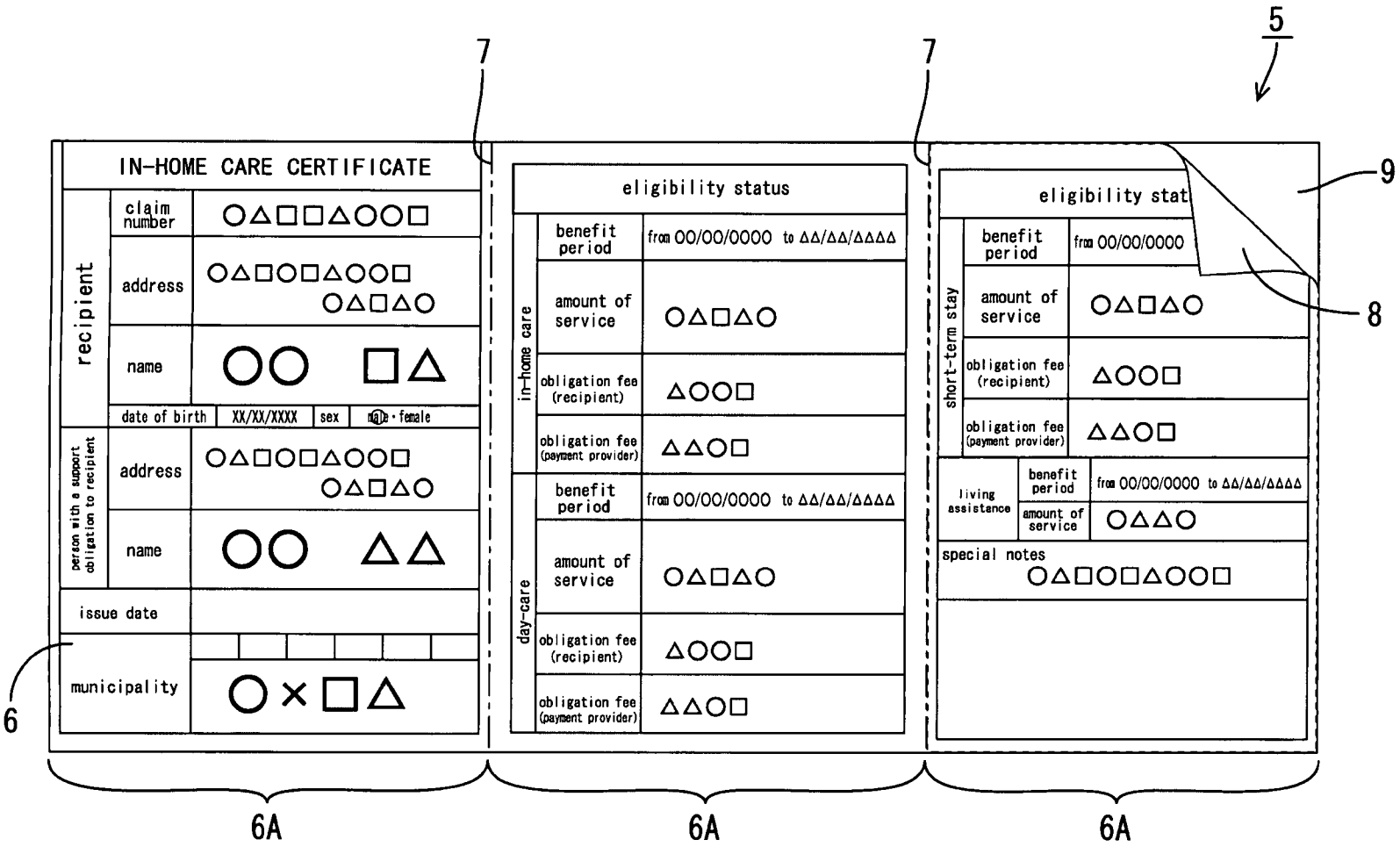
FIG. 2 shows the printable side of a printable sheet of a first embodiment.
Figure 3:
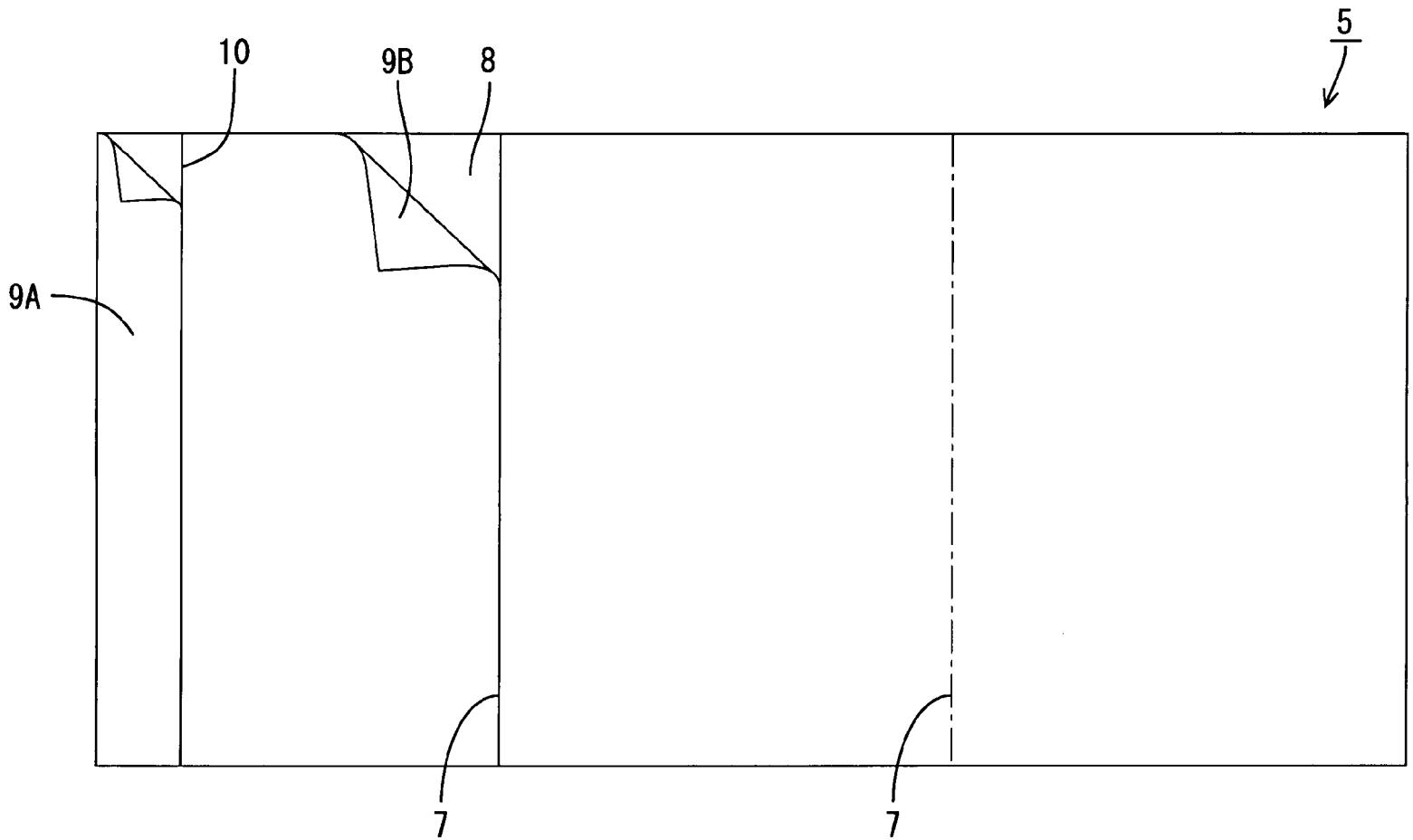
FIG. 3 shows the adhesive side of a printable sheet of a first embodiment.

In the following, the first embodiment of this invention will be described in detail referring to FIGS. 1 to 3. A handbook 1 is the one delivered to a person who is going to receive benefits and support services from a municipality as a certificate of recipient. The handbook 1 is includes a booklet 3 and a printable sheet 5. The booklet 3 contains recording pages 2 (corresponding to the generalized pages). The printable sheet 5 forms private information pages 4 (corresponding to the specialized pages).

The booklet 3 is prepared by binding with a stapler two or more sheet materials within a half folded-cover paper. The sheet materials form recording pages 2. The recording pages 2 are common forms including recording spaces to be filled in at the time the recipient receives services.

The printable sheet 5 is a rectangular landscape sheet of paper approximately the size of three private information pages 4 lined up in a row sideways. The private information pages 4 contain particular content specific for each recipient, such as private information including the name and address of the recipient.

The printable sheet 5 has a printable side 6, printable via a printer. The printable side 6 is divided into three sets of printing spaces 6A, which form three corresponding pages of the private information pages 4. Each printing space 6A has spaces in which the private information of the recipient is written. The size of each printing space 6A, which is approximately equivalent to the size of the specialized page 4, is slightly smaller than the size of the recording page 2. Additionally, fold lines 7 are disposed along the borders between the adjacent printing spaces 6A, by which the printable sheet 5 can be folded up into concertinas.

Figure 1:
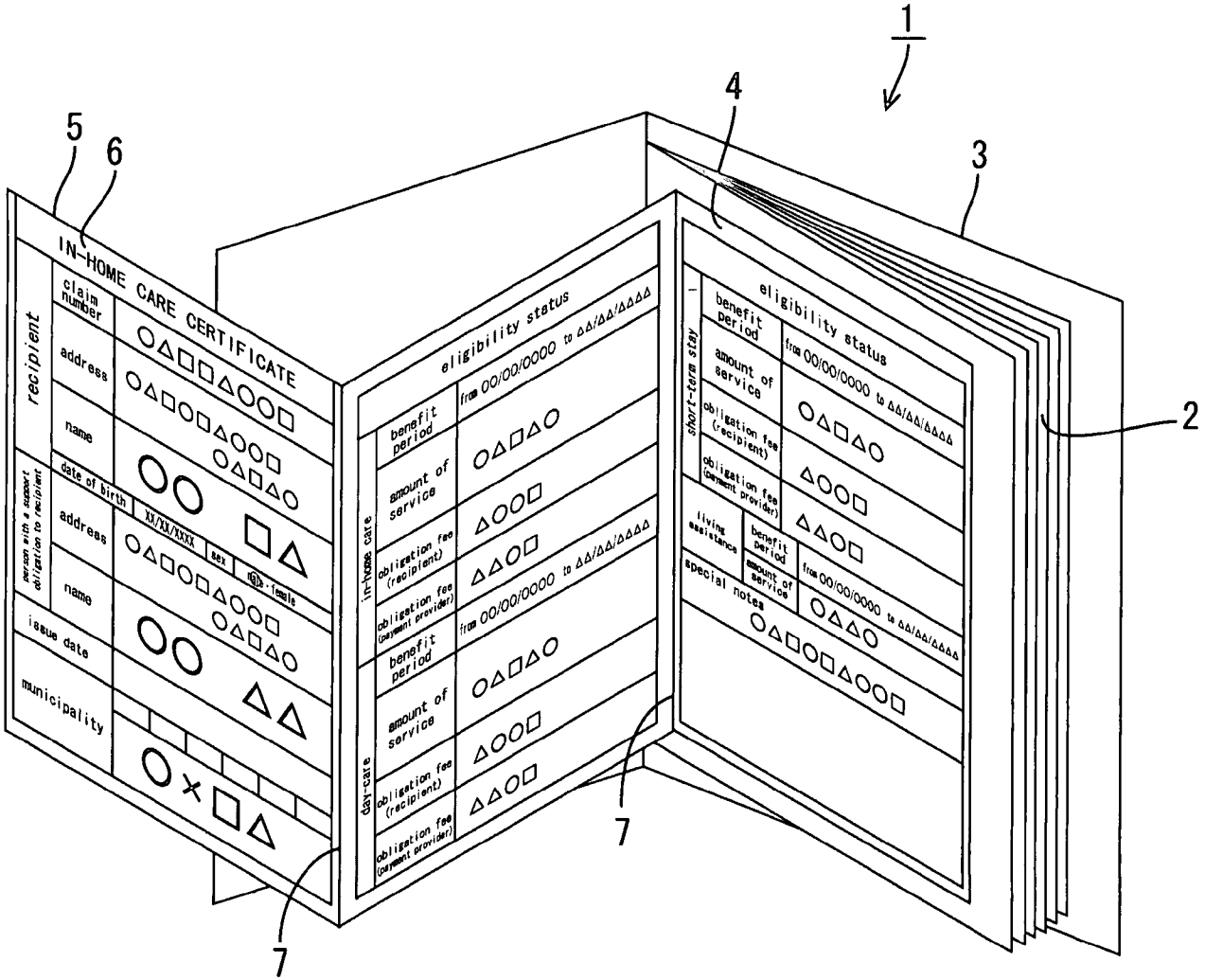
FIG. 1 is a perspective view of a handbook of a first embodiment according to the present invention.

An adhesive layer 8 is formed on the back of the first printing space 6A located at the end, which forms the last page of the private information pages 4 (the rightmost printing space 6A in FIG. 1). The adhesive layer 8 is covered with a detachable sheet 9. The detachable sheet 9 has a vertical slit 10 to separate it into the right detachable sheet 9B and the left detachable sheet 9A.

Upon making the handbook 1, the booklet 3 containing the recording pages 2 is first prepared. The booklet 3 is common for all recipients so that it can be made and bound in volume at a low price, and it can be previously prepared and stored until the time it is needed.

Next, private information for a recipient is entered into the spaces on the printable sheet 5. Before being incorporated into the booklet 3, the printable sheet 5 is a plain sheet material that is printable with a printing means such as a printer. Therefore, the private information can be entered into the spaces on the printable sheet 5 with a printer by retrieving the necessary information from a database previously prepared in a computer etc. and transferring it to a printer. This makes the entry of the private information on the private information page 4 very easy.

In the next step, the preprinted printable sheet 5 is folded into concertinas along the fold lines 7. Then, the detachable sheet 9 is removed from the printable sheet 5 and the printable sheet 5 is attached onto the first page of the recording pages 2 of the booklet 3 via the adhesive layer 8. The left detachable sheet 9A of the detachable sheet 9 is removed first, and the exposed part of the adhesive layer 8 is pressed onto the appropriate position of the recording page 2. Later on, the right detachable sheet 9B of the detachable sheet 9 is removed and the whole back of the rightmost printing space 6A is attached onto the first recording page 2. With this arrangement, when only the small portion of the adhesive layer 8 is initially exposed, adjusting the position of the printable sheet 5 is very easy, and the sticking of the adhesive layer 8 to itself can be prevented.

In this embodiment, the size of the printing space 6A, equal to the size of the specialized page 4, is smaller than that of the recording page 2. This makes positioning and attachment of the preprinted printable sheet 5 onto the recording page 2 easy because the specialized page 4 can fit within the recording page 2 despite small displacements from the ideal positioning. This is the way the handbook 1 of this embodiment is made.

Making a handbook 1 with the preprinted printable sheet 5 and the bound booklet 3 is accomplished so easily that a recipient can make it by oneself. Especially in this embodiment, the positioning and attachment of the preprinted printable sheet onto the recording page 2 is easy because the size of the printing space 6A is smaller than that of the recording page 2.

In this first embodiment, the private information pages 4 are formed by a printable sheet 5. The recording pages 2 are common for all recipients so that the booklet 3 can be previously made and bound in bulk at a low price. On the other hand, the private information can be entered into the spaces on the printable sheet 5 with a printer by retrieving the necessary information from a database and transferring it to a printer. This makes the entry of the private information on the private information page 4 very easy.

Moreover, the adhesive layer 8 is formed on the back of one printing space 6A at the end, which forms the last page of the private information pages 4. The amounts of the adhesive layer 8 and the detachable sheet 9 used to attach the printable sheet 5 onto the recording page 2 in this embodiment are small, so that the cost of the handbook 1 can be reduced.

Furthermore, the size of the printing space 6A, approximately equal to the size of the specialized page 4, is smaller than that of the recording page 2. This makes positioning and attachment of the preprinted printable sheet 5 onto the recording page 2 simple because the specialized page 4 can fit within the recording page 2 despite a small displacement from a desired position.

Second Embodiment

Figure 4:
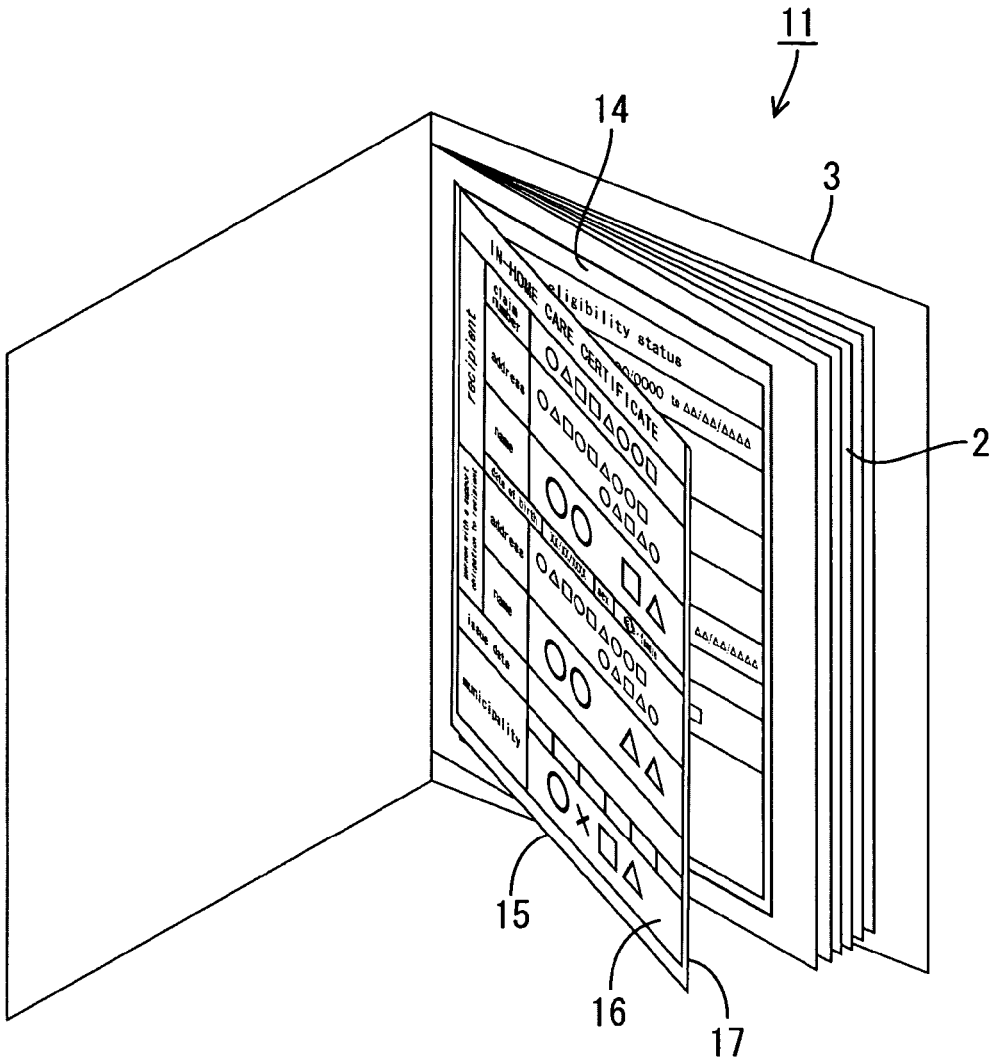
FIG. 4 is a perspective view of a handbook of a second embodiment according to the present invention.
Figure 5:
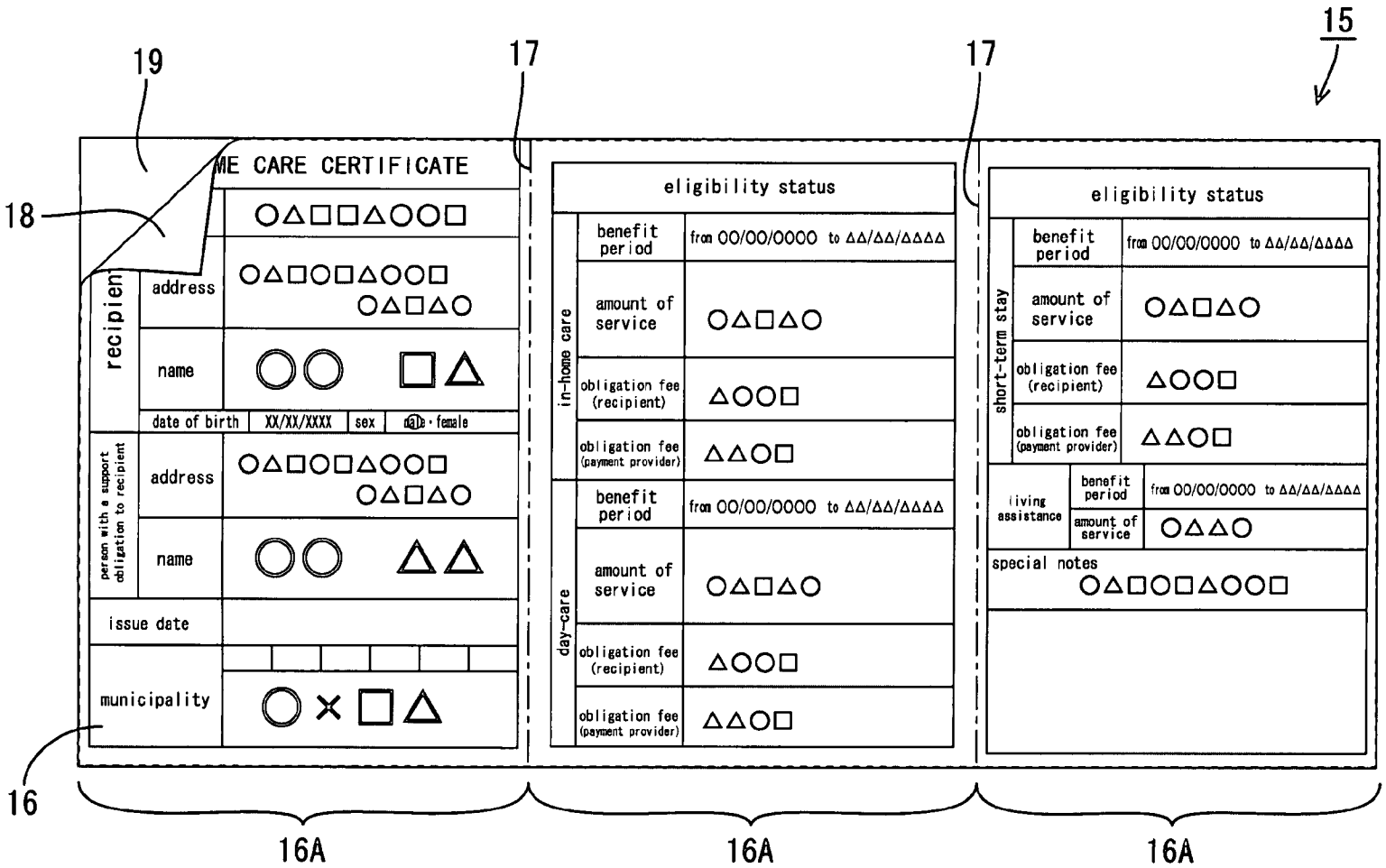
FIG. 5 shows the printable side of a printable sheet of a second embodiment.
Figure 6:
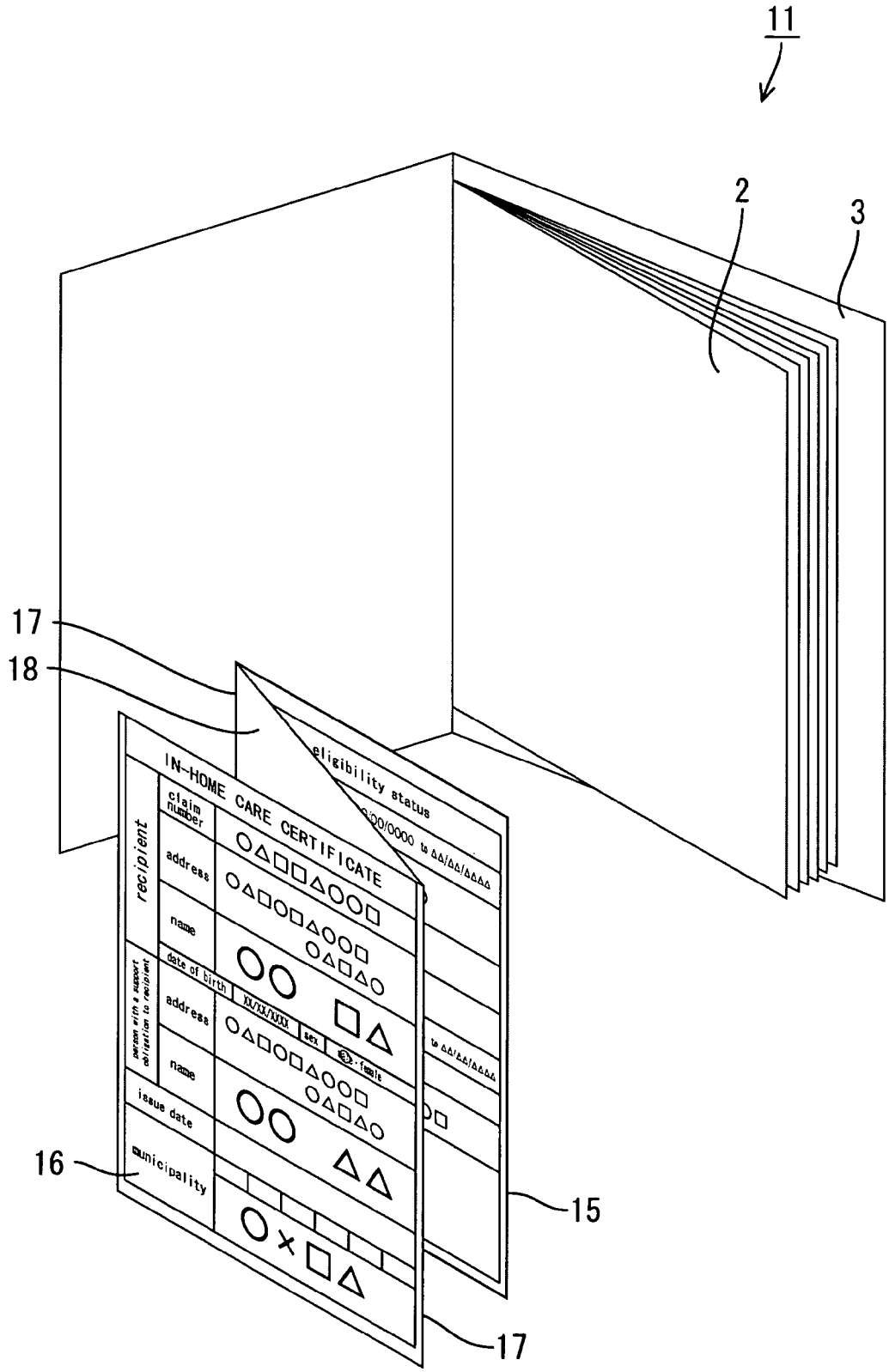
FIG. 6 shows a printable sheet of a second embodiment being attached onto a booklet of a second embodiment.

In the following, the second embodiment of this invention will be described in detail referring to FIGS. 4 to 6. The difference between a handbook 11 of the second embodiment and the handbook 1 of the first embodiment is that an adhesive layer 18 is formed across the back of a printable side 16 of a printable sheet 15. A detachable sheet 19 covers the adhesive layer 18 (FIG. 5). In the following, those parts corresponding to the components of the first embodiment are identified with the same numerals, and the explanation for those parts is omitted.

The printable sheet 15 of this embodiment is also a rectangular landscape sheet of paper approximately the size of three private information pages 14 lined up in a row sideways. The printable sheet 15 has the printable side 16 printed by a printer. The printable side 16 is divided into three printing spaces 16A, which form three corresponding pages of the private information pages 14. Fold lines 17 are disposed along borders between the adjacent printing spaces 16A, by which the printable sheet 15 can be folded up into concertinas. An adhesive layer 18 is formed across the back of the printable side 16 of the printable sheet 15, and a detachable sheet 19 is removably attached to the adhesive layer 18.

For making the handbook 11, the booklet 3 containing the recording pages 2 is prepared. Then, the private information for a recipient is entered into the spaces on the printable sheet 15 in the same manner as in the first embodiment. The preprinted printable sheet 15 is folded into concertinas using the fold lines 17 (FIG. 6). Then, the detachable sheet 19 is removed from the printable sheet 15, and the two printing spaces 6A (located in the leftmost and the second-leftmost positions in FIG. 5) which form the first and second pages of the private information pages 4, are attached back to back with each other. The printing space 6A located in the rightmost position forming the third page of the private information pages 4, is attached onto the first page of the recording pages 2, to incorporate the printable sheet 15 into the booklet 3. This is the way to make the handbook 11 of this embodiment.

The handbook 11 can be made as easily as the handbook 1 of the first embodiment. The printable sheet 15 has fold lines 17 by which the printable sheet can be folded up into concertinas, and the adhesive layer 18 is formed across the back of the printable side 16. With this constitution, the easy-care handbook 11 can be made so that the private information pages 14 can be kept neatly within the handbook 11, even when it is opened.

Third Embodiment

Figure 7:
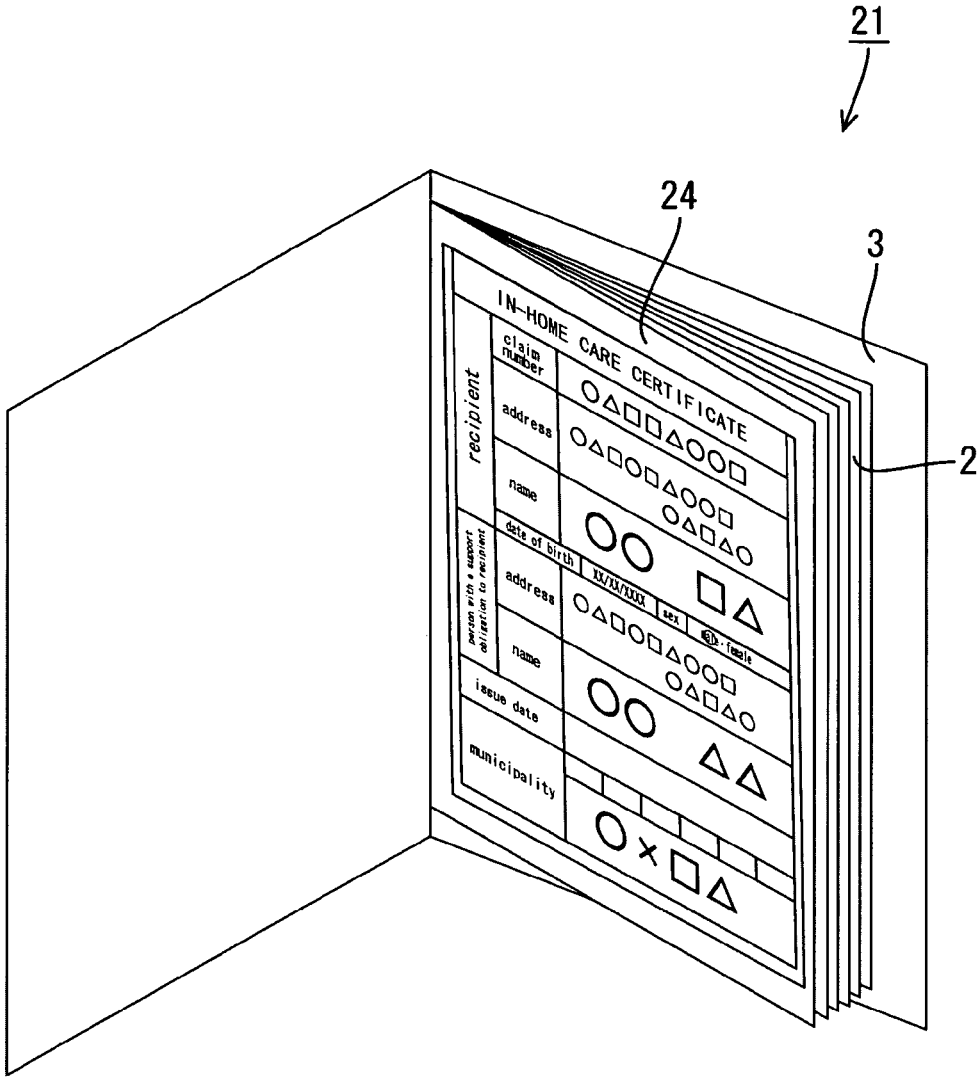
FIG. 7 is a perspective view of a handbook of a third embodiment according to the present invention.
Figure 8:
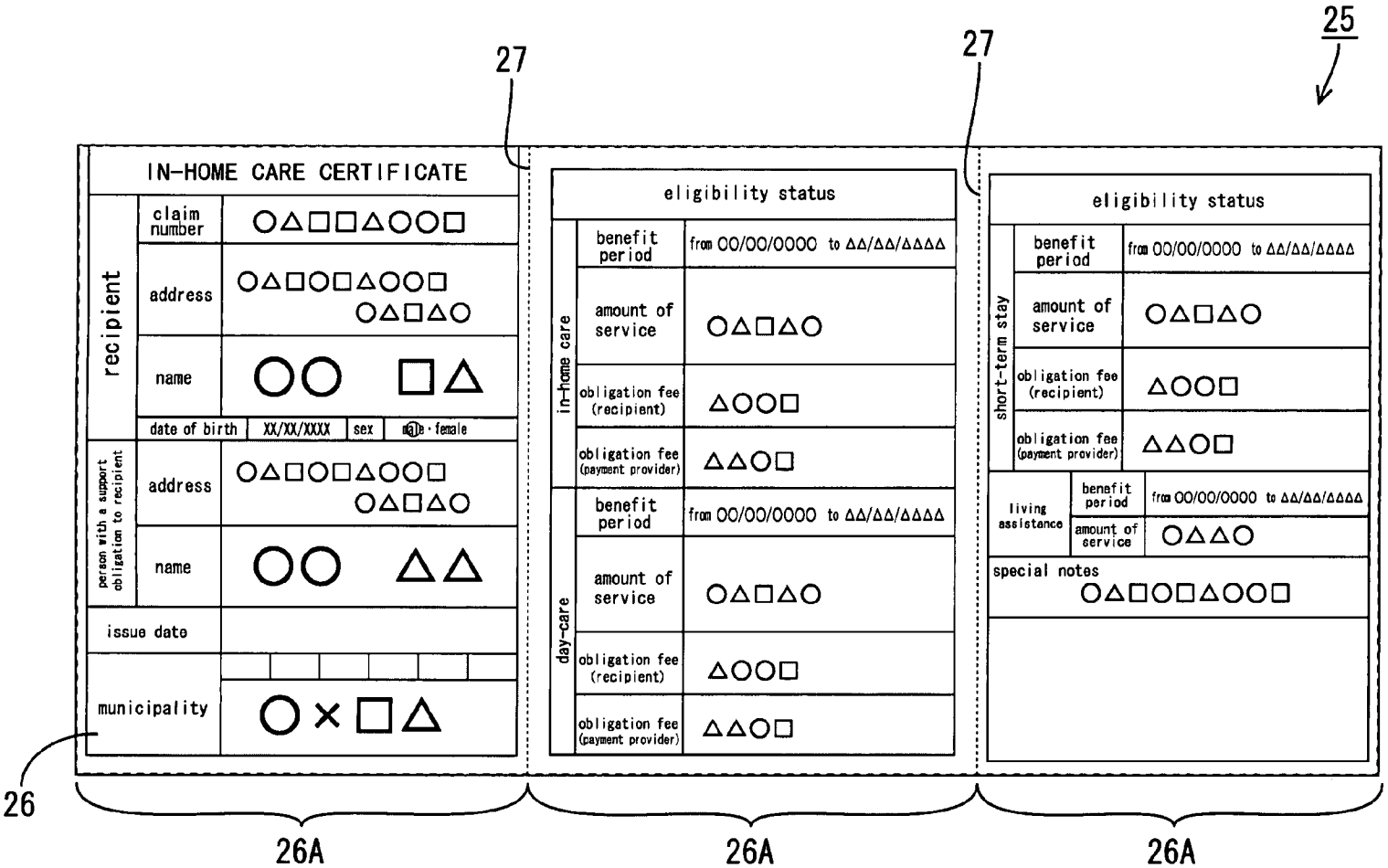
FIG. 8 shows the printable side of a printable sheet of a third embodiment.
Figure 9:
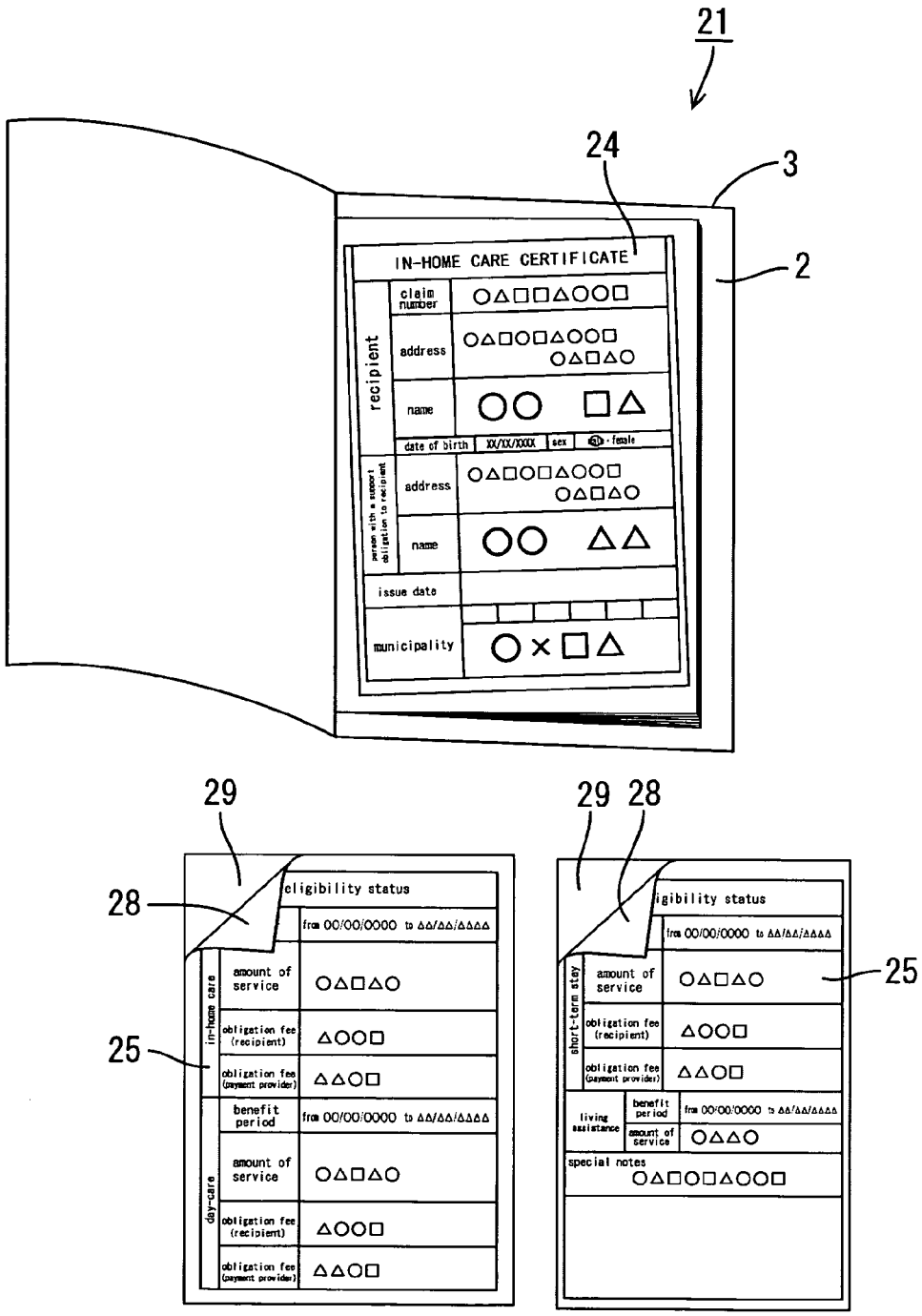
FIG. 9 shows a printable sheet of a third embodiment separated into individual printing space and being attached onto a booklet of a third embodiment.

In the following, the third embodiment of this invention will be described in detail referring to FIGS. 7 to 9. The difference between a handbook 21 of the third embodiment and the handbook 11 of the second embodiment is that perforated lines 27 are disposed along the border between the adjacent printing spaces 26A of the printable sheet 25, by which the printing spaces 26A can be separated one from the other. In the following, as well as in the second embodiment, those parts corresponding to the components of the first and second embodiment are identified with the same numerals and the explanation for those parts are omitted.

The printable sheet 25 of this embodiment is also a rectangular landscape sheet of paper approximately the size of three private information pages 24 lined up in a row sideways. The printable sheet 25 has a printable side 26 printed by a printer. The printable side 26 is divided into three printing spaces 26A which form three corresponding pages of the private information pages 24. Perforated lines 27 are disposed along borders between the adjacent printing spaces 26A, by which the printing spaces 26A can be separated one from the other. An adhesive layer 28 is formed across the back of the printable side 26 of the printable sheet 25. A detachable sheet 29 is removably attached to the adhesive layer 28.

In order to make the handbook 21, the booklet 3 containing the recording pages 2 is prepared. Then, the private information for a recipient is entered into the spaces on the printable sheet 25 in the same manner as in the first and second embodiments. The printing spaces 26A of the preprinted printable sheet 25 are then separated one from the other according to the perforated lines 27. Then, by removing a piece of the detachable sheet 29, each separated piece of the preprinted printable sheet 25 is attached in a desired place on a desired page of the recording pages 2 in the booklet 3, in order to make private information pages 24. This is the way to make the handbook 21 of this embodiment.

The handbook 21 can be easily made as well as the handbooks 1 and 11 of the foregoing embodiments. The printable sheet 25 has perforated lines 27 by which the printing spaces 26A of the printable sheet 25 can be separated one from the other. With this constitution, the handbook 25 is easy to maintain. When the content of one of the private information pages 24 needs to be modified, only one relevant printing space 26A needs to be reprinted and attached over the original page.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

In the foregoing embodiments, three specialized pages 4, 14, and 24 are respectively formed in the handbooks 1, 11, and 21. However, the number of specialized pages is not limited to the three shown, and can be one, two, four or more.

In the foregoing embodiments, a part of the printable sheet 5, 15, and 25 is attached onto the first page of the recording pages 2. However, the place at which the specialized pages are incorporated is not so limited. The printable sheet can be attached onto any page of a booklet 3, such as the last recording page 2 for example.

In the first embodiment, the adhesive layer 8 is formed across the back of the right-most printing space 6A, which also forms the last page of the private information pages 4. However, the position where the adhesive layer is located is not so limited. The adhesive layer for example can be formed on back of the printing space in the middle or in the leftmost positions, which respectively forms the second and first pages of the private information pages 4.

In the first embodiment, the adhesive layer is formed on the entire back of the right-most printing space 6A. However, it can be formed on a portion of the back of the right-most printing space 6A. In a similar way, although the adhesive layer 18 is formed on the entire back of the printable side 16 of the printable sheet 15 in the second embodiment, it can be formed on just a portion of the back of each printing space 6A as long as the adjacent printing spaces can be attached back to back with each other. Moreover, though the adhesive layer 28 is formed on the entire back of the printable side 26 of the printable sheet 25 in the third embodiment, it can be formed on only a portion of the back of each of the printing spaces as long as each separated piece of the printable sheet 25 can be attached onto the desired position of a recording page 2 of the booklet 3.

In the first embodiment, the detachable sheet 9 has a vertical slit 10 to separate the right detachable sheet 9B and the left detachable sheet 9A. However, a slit is not essential in this invention, and alternatively for example, a horizontal slit can be formed to separate the detachable sheet 9 into an upper part and a lower part.

In the third embodiment, all the printing spaces 26A are separated from each other. However, only some of the multiple spaces 26A may be separated from the other parts of the printable sheet. For example, in some cases, only one printing space is separated from the other three or more printing spaces. The separated single printing space can be attached onto the desired position of the desired page. At the same time, the other part of the printable sheet, still containing multiple printing spaces, can be folded into concertinas and a part attached onto a recording page.

What is claimed is:

1. A handbook comprising:

at least two generalized pages permanently bound together, each of said generalized pages being of a general nature with respect to said handbook; and at least one printed printable sheet, each of said at least one printed printable sheet containing printed content of a specific nature with respect to said handbook, each of said at least one printed printable sheet comprising:

an adhesive side having an adhesive layer covering at least a portion of said adhesive side, said adhesive side being shaped and arranged to attach said at least one printed printable sheet to at least one of said generalized pages so as to attach said at least one specialized page to said bound generalized pages;

a printable side containing said printed content of a specific nature with respect to said handbook; and a detachable sheet removably attached to a surface of said adhesive side so as to cover at least a portion of said adhesive layer.

2. The handbook of claim 1, wherein said handbook is operable to perform at least one operation of a group of operations consisting of operating as an official record and operating as an indication of qualification.

3. The handbook of claim 2, wherein said printed content includes content printed on said printable side by a printing means after content data corresponding to said printed content is retrieved from a database and transferred to the printing means.

4. The handbook of claim 2, wherein said printed content includes content printed on said printable side by a printing means after content data corresponding to said printed content is retrieved from a database and transferred to the printing means.

* * * * *